US008402731B2

(12) United States Patent
Naito et al.

(10) Patent No.: US 8,402,731 B2
(45) Date of Patent: Mar. 26, 2013

(54) ELEVATOR ROPE

(75) Inventors: Shinya Naito, Tokyo (JP); Mamoru Terai, Tokyo (JP); Michio Murai, Tokyo (JP); Hiroshi Kigawa, Tokyo (JP); Hiroyuki Nakagawa, Tokyo (JP); Muneaki Mukuda, Tokyo (JP); Atsushi Mitsui, Tokyo (JP); Rikio Kondo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/123,403

(22) PCT Filed: Dec. 9, 2009

(86) PCT No.: PCT/JP2009/070597

§ 371 (c)(1),
(2), (4) Date: Apr. 8, 2011

(87) PCT Pub. No.: WO2010/071061

PCT Pub. Date: Jun. 24, 2010

(65) Prior Publication Data

US 2011/0192131 A1 Aug. 11, 2011

(30) Foreign Application Priority Data

Dec. 17, 2008 (JP) ..... 2008-320679

(51) Int. Cl.
*D02G 3/22* (2006.01)

(52) U.S. Cl. ..... 57/210

(58) Field of Classification Search ..... 57/210, 57/231, 232, 236, 241, 258
See application file for complete search history.

(56) References Cited

U.S. PATENT DOCUMENTS 4,347,338 A 8/1982 Torii et al.
4,624,097 A * 11/1986 Wilcox ..... 57/232
RE34,830 E * 1/1995 Satoji ..... 508/304

(Continued)

FOREIGN PATENT DOCUMENTS

CN 1177100 C 11/2004
CN 100365195 C 1/2008

(Continued)

OTHER PUBLICATIONS

Grosch, K.A., "The relation between the friction and visco-elastic properties of rubber." Proc. Roy. Soc., A274, 21 (1963). p. 24-26.

(Continued)

*Primary Examiner* — Shaun R Hurley
(74) *Attorney, Agent, or Firm* — Oblon, Spivak, McClelland, Maier & Neustadt, L.L.P.

(57) ABSTRACT

An elevator rope including a rope main body; and a covering resin layer that covers the periphery of the rope main body and comprises a molded product of a composition which composition is produced by mixing a thermoplastic polyurethane elastomer, a thermoplastic resin other than the thermoplastic polyurethane elastomer and an isocyanate compound having two or more isocyanate groups per molecule; a rope main body impregnated with an impregnating solution comprising a hydroxy compound having two or more hydroxy groups per molecule and an isocyanate compound having two or more isocyanate groups per molecule and having a lower viscosity than a melt viscosity of the composition for forming the covering resin layer is used as the rope main body; the elevator rope has a stable friction coefficient that does not depend on temperature or sliding velocity.

15 Claims, 6 Drawing Sheets

U.S. PATENT DOCUMENTS

| | | | | |
|---|---|---|---|---|
| 7,137,483 | B2 * | 11/2006 | Kato et al. | 187/251 |
| 2003/0024770 | A1 * | 2/2003 | O'donnell et al. | 187/251 |
| 2004/0026178 | A1 | 2/2004 | Honda | |
| 2005/0034375 | A1 * | 2/2005 | Vanderbeken et al. | 49/507 |
| 2005/0060979 | A1 * | 3/2005 | Aulanko et al. | 57/232 |
| 2006/0174604 | A1 | 8/2006 | Vanderbeken et al. | |
| 2008/0078157 | A1 * | 4/2008 | Dold et al. | 57/212 |

FOREIGN PATENT DOCUMENTS

| | | | |
|---|---|---|---|
| CN | 100365197 | C | 1/2008 |
| JP | 56 167430 | | 12/1981 |
| JP | 62 53495 | | 3/1987 |
| JP | 3 249 289 | | 11/1991 |
| JP | 2001 262482 | | 9/2001 |
| JP | 2004 106984 | | 4/2004 |
| JP | 2005 220451 | | 8/2005 |
| JP | 2006 519321 | | 8/2006 |
| JP | 2006 335952 | | 12/2006 |
| JP | 2009 234791 | | 10/2009 |
| WO | 2003 050348 | | 6/2003 |

OTHER PUBLICATIONS

International Search Report issued Mar. 9, 2010 in PCT/JP09/70597 filed Dec. 9, 2009.

Combined Office Action and Search Report issued Oct. 30, 2012 in Chinese Patent Application No. 200980146168.0 with English language translation.

* cited by examiner

ELEVATOR ROPE

TECHNICAL FIELD

The present invention relates to an elevator rope for suspending an elevator car.

BACKGROUND ART

A sheave having a diameter 40 times or more the diameter of a rope has been conventionally used in an elevator apparatus in order to prevent early abrasion or breakage of the rope. Therefore, in order to reduce the diameter of the sheave, it is also necessary to make the diameter of the rope smaller. However, if the diameter of the rope is made smaller without changing the number of ropes, then there is a risk that a car may more easily vibrate due to load variations caused by baggage loaded in the car or passengers getting on and off the car, and rope vibrations at the sheave may be transmitted to the car. Further, an increase in the number of ropes results in a complicated structure of the elevator apparatus. In addition, if the diameter of a driving sheave is made smaller, driving frictional force is reduced. As a result, the weight of the car needs to be increased.

As means for solving such problems, it has been proposed to use a rope obtained by: twisting a plurality of steel wires together to form strands; twisting a plurality of the strands together to forma wire rope; and covering the outermost periphery of the wire rope with a resin material (for example, see Patent Literature 1). An elevator using such rope is driven by a frictional force between a sheave and the resin material forming the outermost periphery. Therefore, it is desired to stabilize or improve the friction characteristics of the resin material. Accordingly, in order to improve the friction characteristics of an elevator rope, it has been proposed to use a rope covered with a polyurethane covering material containing no wax (for example, see Patent Literature 2).

In general, the friction coefficient of a resin material is known to heavily depend on sliding velocity and temperature. Further, viscoelastic characteristics such as dynamic viscoelasticity of the resin material are known to have velocity and temperature dependencies which can be converted into each other (Williams-Landel-Ferry equation (WLF equation)). In addition, such conversion is achieved for the sliding velocity and temperature as well in the case of rubber friction, and hence it has been shown that the viscoelastic characteristics of rubber are involved in the friction characteristics of the rubber (for example, see Non Patent Literature 1).

[Patent Literature 1] Japanese Patent Laid-Open No. 2001-262482

[Patent Literature 2] Japanese Patent Laid-Open No. 2004-538382

[Non Patent Literature 1] Grosch, K. A.: Proc. Roy. Soc., A274, 21 (1963)

SUMMARY OF INVENTION

Technical Problem

As is clear from the above-mentioned facts, even in the polyurethane covering material containing no wax described in Patent Literature 2, the friction coefficient of the material itself varies depending on the sliding velocity and temperature, and hence there has been a problem in that it is impossible to stably control an elevator. Further, as described in Non Patent Literature 1, the friction coefficient of rubber has a maximal value for the sliding velocity. In order to stop an elevator for a long period of time, it is necessary to maintain the static condition of a car by the frictional force between a rope and a sheave. However, such conventional covering material having a large variation in friction coefficient has a problem in that the friction coefficient cannot be secured at a certain level or more at a small sliding velocity, resulting in a misalignment of the stop position of the car with time. Meanwhile, in order to perform an emergency stop or sudden stop of the elevator in operation, it is necessary to brake the elevator by the frictional force between the rope and the sheave, but the conventional covering material may cause a decrease in strength or melting by frictional heat. In such case, there has been a problem in that the friction coefficient between the rope and the sheave significantly decreases.

Therefore, the present invention has been made to solve the above-mentioned problems, and an object of the present invention is to obtain an elevator rope which has a stable friction coefficient that does not depend on temperature or sliding velocity.

Solution to Problem

The inventors of the present invention have made studies on frictional characteristics of a variety of resin materials. FIG. 1 is an example of results illustrating frequency dependency of loss moduli in materials having different sliding velocity dependency of friction coefficients. As is clear from FIG. 1, the inventors have found that a material having small sliding velocity dependency of the friction coefficient has small frequency dependency of the loss modulus in a viscoelastic master curve. Based on such findings, the inventors have studied the compositions of resin materials, and as a result, have found that, in order to reduce both the frequency dependency of the loss modulus and sliding velocity dependency of the friction coefficient, it is useful to use, as a layer for covering the periphery of a rope main body, a resin material obtained by adding a thermoplastic resin other than a thermoplastic polyurethane elastomer and an isocyanate compound having two or more isocyanate groups per molecule to a thermoplastic polyurethane elastomer or a resin material obtained by adding inorganic fillers to the thermoplastic polyurethane elastomer, thus completing the present invention.

That is, the present invention is an elevator rope, including: a rope main body; and a covering resin layer that covers the periphery of the rope main body and comprises a molded product of a composition for forming the covering resin layer, wherein the composition is produced by mixing a thermoplastic polyurethane elastomer, a thermoplastic resin other than the thermoplastic polyurethane elastomer and an isocyanate compound having two or more isocyanate groups per molecule.

Further, the present invention is an elevator rope, including: a rope main body; and a covering resin layer that covers the periphery of the rope main body and comprises a molded product of a composition for forming the covering resin layer, wherein the composition is produced by mixing a thermoplastic polyurethane elastomer and inorganic fillers.

Advantageous Effects of the Invention

According to the present invention, it is possible to obtain an elevator rope which has a stable friction coefficient that does not depend on temperature or the sliding velocity by using, as a layer for covering the periphery of a rope main body, a molded product of the composition for forming a covering resin layer produced by adding the thermoplastic resin other than the thermoplastic polyurethane elastomer and the isocyanate compound having two or more isocyanate groups per molecule to the thermoplastic polyurethane elastomer or the composition for forming a covering resin layer produced by adding the inorganic fillers to the thermoplastic polyurethane elastomer.

DESCRIPTION OF EMBODIMENTS

Figure 1:
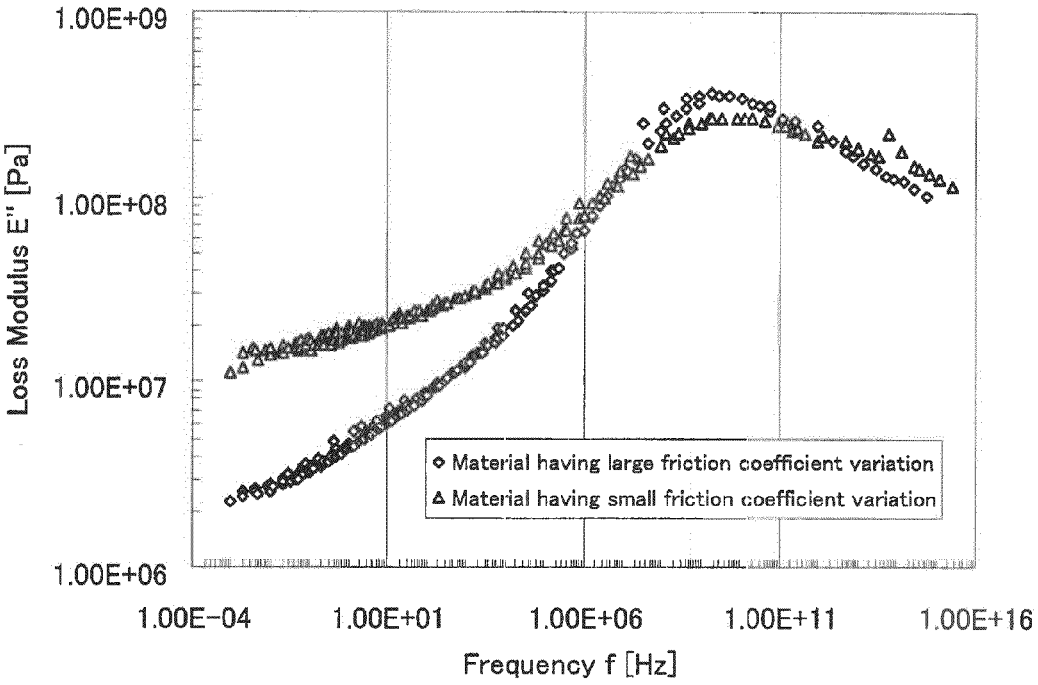
FIG. 1 is an example of results illustrating frequency dependency of loss moduli in materials having different sliding velocity dependency of friction coefficients (viscoelastic master curves).

Embodiments of the present invention are described below.

Embodiment 1

An elevator rope according to Embodiment 1 of the present invention is characterized in that the periphery of a rope main body is covered with a molded product of a composition for forming a covering resin layer, wherein the composition is produced by mixing a thermoplastic polyurethane elastomer, a thermoplastic resin other than the thermoplastic polyurethane elastomer and an isocyanate compound having two or more isocyanate groups per molecule.

Examples of the thermoplastic polyurethane elastomer used in this embodiment include an ester-based thermoplastic polyurethane elastomer, an ether-based thermoplastic polyurethane elastomer, an ester-ether-based thermoplastic polyurethane elastomer, and a carbonate-based thermoplastic polyurethane elastomer. The elastomers may be used alone or in combinations of two or more kinds thereof.

Of those thermoplastic polyurethane elastomers, an ether-based thermoplastic polyurethane elastomer is preferably used to prevent hydrolysis which occurs in a usage environment. In consideration of flexibility and durability of the elevator rope, a polyether-based thermoplastic polyurethane elastomer having a JIS A hardness (hardness specified by JIS K7215 using a type A durometer) of 85 or more and 95 or less is more preferably used.

Meanwhile, from the viewpoint of workability such as the mixing of the thermoplastic resin other than the thermoplastic polyurethane elastomer with the isocyanate compound having two or more isocyanate groups per molecule, a thermoplastic polyurethane elastomer processed into pellets is preferably used.

Examples of the isocyanate compound having two or more isocyanate groups per molecule, which is used in this embodiment, include: aliphatic isocyanates such as 1,6-hexamethylene diisocyanate, 2,2,4-trimethyl hexamethylene diisocyanate, lysine methyl ester diisocyanate, methylene diisocyanate, isopropylene diisocyanate, lysine diisocyanate, 1,5-octylene diisocyanate, and a dimer acid diisocyanate; alicyclic isocyanates such as 4,4'-dicyclohexylmethane diisocyanate, isophorone diisocyanate, hydrogenated tolylene diisocyanate, methyl cyclohexane diisocyanate, and isopropylidene dicyclohexyl-4,4'-diisocyanate; and aromatic isocyanates such as 2,4- or 2,6-tolylene diisocyanate, 4,4'-diphenylmethane diisocyanate, 1,5-naphthylene diisocyanate, xylylene diisocyanate, triphenylmethane triisocyanate, tris(4-phenyl isocyanate) thiophosphate, tolidine diisocyanate, p-phenylene diisocyanate, diphenyl ether diisocyanate, and diphenylsulfone diisocyanate. Those compounds may be used alone or in combinations of two or more kinds thereof. Alternatively, an isocyanate prepolymer having isocyanate groups at its molecular ends, which can be obtained by reacting an active hydrogen compound such as a polyol or a polyamine with the above-mentioned isocyanate, can also be used as the isocyanate compound having two or more isocyanate groups per molecule.

From the viewpoint of workability such as the mixing with the thermoplastic polyurethane elastomer, the isocyanate compound described above is used as a resin composition (hereinafter, referred to as "isocyanate batch") in the form of powder, flakes, or pellets, in which the thermoplastic resin other than the thermoplastic polyurethane elastomer and the isocyanate compound are preliminarily mixed. Examples of the thermoplastic resin other than the thermoplastic polyurethane elastomer, which is used in this case, include an epoxy resin, a polystyrene resin, a polyvinyl chloride resin, a polyvinyl acetate resin, an ethylene-vinyl acetate copolymer resin, a polyethylene resin, a polypropylene resin, and a polyester resin.

The covering resin layer used in this embodiment is usually obtained by: mixing the above-mentioned thermoplastic polyurethane elastomer pellets and the above-mentioned isocyanate batch to prepare a composition for forming a covering resin layer; and feeding the composition into a molding machine such as an extrusion molding machine or an injection molding machine to mold the composition. The mixing ratio is not particularly limited, but is preferably adjusted so that the amount of the isocyanate batch is in the range of 5 parts by mass or more and 20 parts by mass or less with respect to 100 parts by mass of the thermoplastic polyurethane elastomer, and the molded product obtained has a JIS A hardness of 98 or less and a glass transition temperature of −20° C. or less. If the amount of the isocyanate batch is less than 5 parts by mass, a covering resin layer having a stable friction coefficient may not be obtained, while if the amount is more than 20 parts by mass, the flexibility and durability of the rope may be impaired. In particular, in the case of using a thermoplastic polyurethane elastomer having a JIS A hardness of 95, the isocyanate compound is more preferably blended in an amount in the range of 5 parts by mass or more and 10 parts by mass or less with respect to 100 parts by mass of the thermoplastic polyurethane.

The reason why the JIS A hardness of the molded product is specified as 98 or less is that studies by the inventors have revealed that, in the case where the hardness is more than 98, the flexibility of the rope is liable to be impaired, resulting in an increase in the power consumption of the elevator. The JIS A hardness of the molded product is more preferably 85 or more and 98 or less.

Meanwhile, the reason why the glass transition temperature of the molded product (sliding velocity dependency of the friction coefficient becomes smaller as the glass transition temperature of the molded product increases, while the elastic modulus of the molded product becomes larger as the glass transition temperature of the molded product increases) is specified as −20° C. or less is that studies by the inventors have revealed that, in the case where a molded product having a higher glass transition temperature is employed for an elevator rope as the covering resin layer, the flexibility of the rope is liable to be impaired or fatigue failure such as cracking of the covering resin layer is liable to occur due to stress applied to the covering resin layer when the rope is bent repeatedly in an environment having a temperature higher than the glass transition temperature of the molded product. The glass transition temperature of the molded product is more preferably −25° C. or less.

The friction coefficient can be more stabilized against temperature or sliding velocity by adding inorganic fillers to the above-mentioned composition for forming a covering resin layer. Examples of the inorganic filler include: a spherical inorganic filler such as calcium carbonate, silica, titanium oxide, carbon black, acetylene black, or barium sulfate; a fibrous inorganic filler such as a carbon fiber or a glass fiber; and a plate-like inorganic filler such as mica, talc, or bentonite. The fillers may be used alone or in combinations of two or more kinds thereof. Of those, in order to reduce a variation in the friction coefficient, a fibrous inorganic filler and a plate-like inorganic filler are preferably used. The composition for forming a covering resin layer having added thereto the inorganic filler has improved thermal conductivity compared with a composition for forming a covering resin layer having added thereto no inorganic filler, and hence the composition can suppress a temperature variation on a friction interface, resulting in reduction of the variation in the friction coefficient even in the case where frictional heat is generated on the surface of the rope.

The blending amount of the inorganic fillers may be appropriately adjusted so that the molded product has a JIS A hardness of 98 or less and a glass transition temperature of −20° C. or less.

It should be noted that the elevator rope according to this embodiment is characterized by the resin material of the outermost layer that covers the periphery of the rope main body. Therefore, the structure of the rope main body is not particularly limited, but in general, the rope main body contains strands or cords formed by twisting a plurality of steel wires together as a load-supporting member. The rope main body in this embodiment may have a belt shape including the above-mentioned strands or cords. Meanwhile, in order to improve adhesion between the rope main body and the covering resin layer, an adhesive for metal and polyurethane such as Chemlok (registered trademark) 218 (manufactured by LORD Far East, Inc.) is preferably applied in advance to the above-mentioned strands or cords. Further, the inorganic filler as exemplified above may be added to the adhesive for metal and polyurethane.

According to Embodiment 1, it is possible to obtain an elevator rope having a small variation in the friction coefficient in a wide range of sliding velocities from a small sliding velocity range required for maintaining a static condition of an elevator car to a large sliding velocity range during emergency or sudden stops of an elevator in operation.

Embodiment 2

An elevator rope according to Embodiment 2 of the present invention is characterized in that the periphery of a rope main body is covered with a molded product of a composition for forming a covering resin layer, which is produced by mixing a thermoplastic polyurethane elastomer and inorganic fillers.

The thermoplastic polyurethane elastomer and rope main body used in this embodiment are the same as those in Embodiment 1, and hence descriptions of them are omitted.

Examples of the inorganic filler used in this embodiment include: a spherical inorganic filler such as calcium carbonate, silica, titanium oxide, carbon black, acetylene black, or barium sulfate; a fibrous inorganic filler such as a carbon fiber or a glass fiber; and a plate-like inorganic filler such as mica, talc, or bentonite. The fillers may be used alone or in combinations of two or more kinds thereof. Of those, in order to reduce a variation in the friction coefficient, a fibrous inorganic filler and a plate-like inorganic filler are preferably used. The composition for forming a covering resin layer having added thereto the inorganic filler has improved thermal conductivity compared with a composition for forming a covering resin layer having added thereto no inorganic filler, and hence the composition can suppress temperature variation on the friction interface, resulting in reduction of variations in the friction coefficient even in cases where frictional heat is generated on the surface of the rope.

The mixing ratio between the thermoplastic polyurethane elastomer and inorganic filler is not particularly limited, but is preferably adjusted so that the inorganic filler is mixed in an amount within the range of 3 parts by mass or more and 20 parts by mass or less with respect to 100 parts by mass of the thermoplastic polyurethane elastomer and so that the molded product has a JIS A hardness of 98 or less and a glass transition temperature of −20° C. or less. If the amount of the inorganic filler is less than 3 parts by mass, a covering resin layer having a stable friction coefficient may not be obtained, while if the amount is more than 20 parts by mass, flexibility of the rope may be impaired or the covering resin layer may become fragile.

According to Embodiment 2, it is possible to obtain an elevator rope having a small variation in the friction coefficient in a wide range of sliding velocities from a small sliding velocity range required for maintaining a static condition of an elevator car to a large sliding velocity range during emergency or sudden stops of an elevator in operation.

Embodiment 3

An elevator rope according to Embodiment 3 of the present invention is characterized in that the periphery of a rope main body impregnated with an impregnating solution which contains a hydroxy compound having two or more hydroxy groups per molecule and an isocyanate compound having two or more isocyanate groups per molecule is covered with a molded product of a composition for forming a covering resin layer, which is produced by mixing a thermoplastic polyurethane elastomer, a thermoplastic resin other than the thermoplastic polyurethane elastomer, and an isocyanate compound having two or more isocyanate groups per molecule. It should be noted that the impregnating solution has a lower viscosity than the melt viscosity of the composition for forming a covering resin layer.

The elevator rope according to this embodiment is the same as that in Embodiment 1 except that the rope main body impregnated with the impregnating solution is used as the rope main body, and hence descriptions of the covering resin layer are omitted. Meanwhile, as the rope main body before impregnation with the impregnating solution, the rope main body as exemplified in Embodiment 1 may be used. Further, in order to improve adhesion between the rope main body impregnated with the impregnating solution and the covering resin layer, an adhesive may be applied to the rope main body before covering with the covering resin layer. The type of adhesive is not particularly limited, but epoxy-based, phenol-based, and urethane-based adhesives are preferred.

Examples of the hydroxy compound having two or more hydroxy groups per molecule, which is used in this embodiment include, ethylene glycol, propylene glycol, butanediol, diethylene glycol, 3-methylpentane glycol, glycerin, hexanetriol, trimethylolpropane, and tetraethylene glycol. Those compounds may be used alone or in combinations of two or more kinds thereof.

Examples of the isocyanate compound having two or more isocyanate groups per molecule, which is used in this embodiment, include: aliphatic isocyanates such as 1,6-hexamethylene diisocyanate, 2,2,4-trimethyl hexamethylene diisocyanate, lysine methyl ester diisocyanate, methylene diisocyanate, isopropylene diisocyanate, lysine diisocyanate, 1,5-octylene diisocyanate, and a dimer acid diisocyanate; alicyclic isocyanates such as 4,4'-dicyclohexylmethane diisocyanate, isophorone diisocyanate, hydrogenated tolylene diisocyanate, methyl cyclohexane diisocyanate, and isopropylidene dicyclohexyl-4,4'-diisocyanate; and aromatic isocyanates such as 2,4- or 2,6-tolylene diisocyanate, 4,4'-diphenylmethane diisocyanate, 1,5-naphthylene diisocyanate, xylylene diisocyanate, triphenylmethane triisocyanate, tris(4-phenyl isocyanate) thiophosphate, tolidine diisocyanate, p-phenylene diisocyanate, diphenyl ether diisocyanate, and diphenylsulfone diisocyanate. Those compounds may be used alone or in combinations of two or more kinds thereof. Alternatively, an isocyanate prepolymer having isocyanate groups at its molecular ends, which can be obtained by causing an active hydrogen compound such as a polyol or a polyamine to react with the above-mentioned isocyanate, can also be used as the isocyanate compound having two or more isocyanate groups per molecule.

The impregnating solution used in this embodiment is prepared by dissolving the above-mentioned hydroxy compound and isocyanate compound in a solvent. The solvent used in this case is not particularly limited as long as the solvent can dissolve the hydroxy compound and isocyanate compound, and examples thereof include toluene, methyl isobutyl ketone, methyl ethyl ketone, xylene, butyl acetate, and ethyl acetate. Those solvents may be used alone or in combinations of two or more kinds thereof. Meanwhile, the impregnating solution may be prepared by mixing a solution obtained by dissolving the hydroxy compound in a solvent and a solution obtained by dissolving the isocyanate compound in a solvent. In this case, the solvents used for dissolving the hydroxy compound and isocyanate compound may have the same composition or different compositions.

The ratio between the hydroxy compound and isocyanate compound in the impregnating solution is not particularly limited, but is preferably adjusted so as to be hydroxy group: isocyanate group=1:1.

Figure 2:
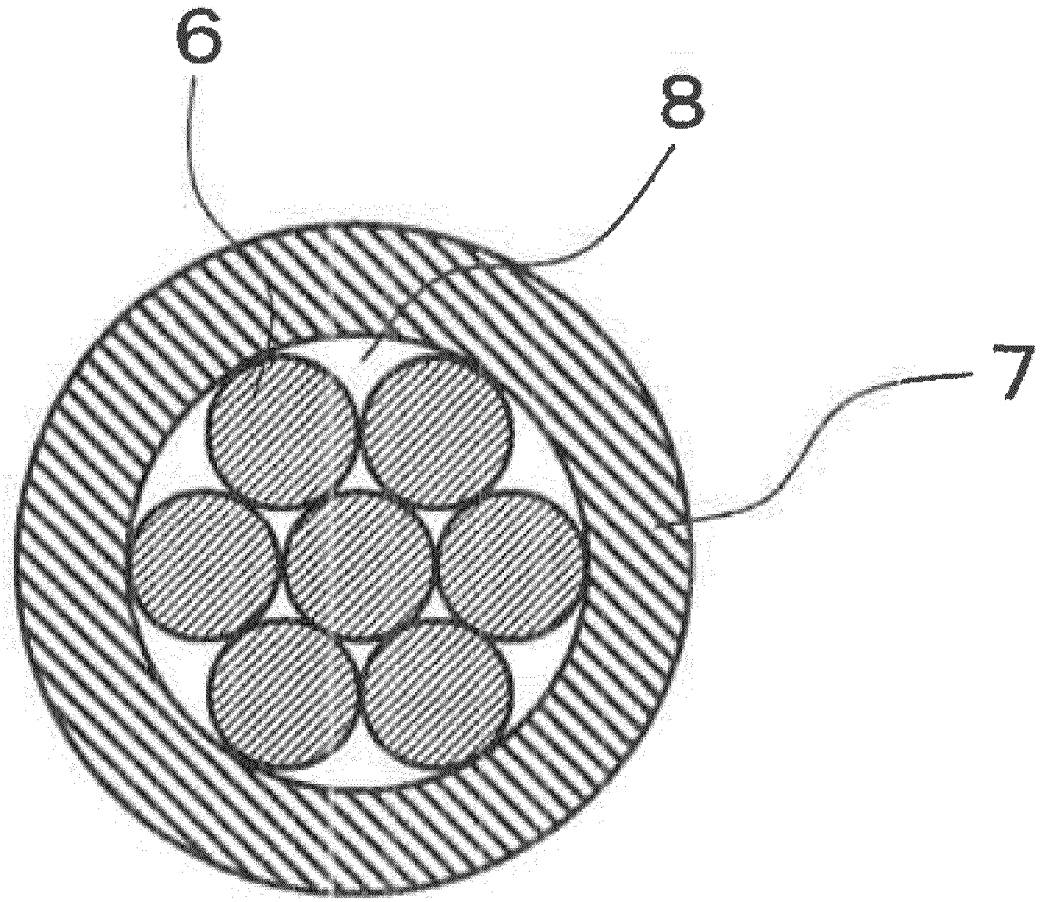
FIG. 2 is a schematic cross-sectional view of an example of an elevator rope using strands not impregnated with impregnating solution.

FIG. 2 is a schematic cross-sectional view of an example of an elevator rope obtained by covering the periphery of strands 6 impregnated with no impregnating solution with a covering resin layer 7 including a molded product of a composition for forming a covering resin layer, which is produced by mixing a thermoplastic polyurethane elastomer, a thermoplastic resin other than the thermoplastic polyurethane elastomer, and an isocyanate compound having two or more isocyanate groups per molecule. As illustrated in FIG. 2, in the elevator rope using the strands 6 impregnated with no impregnating solution, an air layer 8 may appear between the strands 6 and the covering resin layer 7 due to variations in production steps (such as a variation in the composition of materials for forming the covering resin layer, molding temperature, heat-hardening temperature, and heat-hardening time). If the air layer 8 appears, it becomes difficult to release heat generated by friction, e.g., heat generated on a friction interface at the time of an emergency stop of the elevator, from the friction interface, and hence the temperature on the friction interface varies drastically, resulting in a large variation in the friction coefficient. In many cases, the air layer 8 appears in gaps in the strands 6 or in valley parts between wires in the strands 6.

Figure 3:
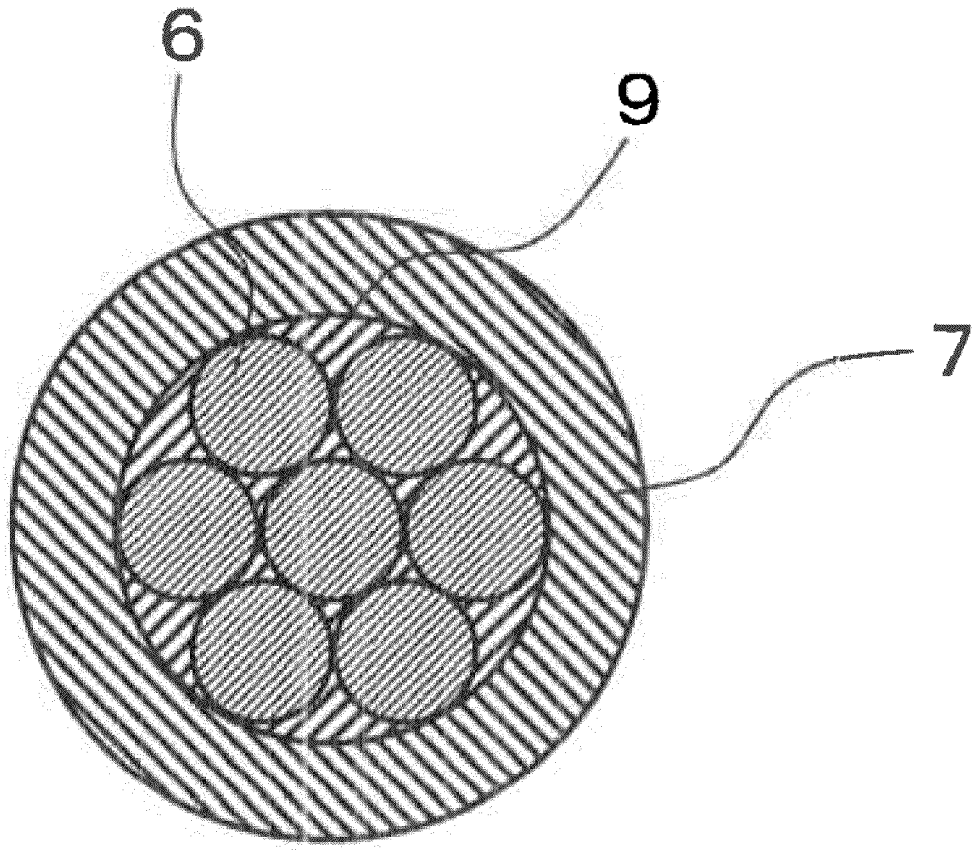
FIG. 3 is a schematic cross-sectional view of an example of an elevator rope according to Embodiment 3.

FIG. 3 is a schematic cross-sectional view of an example of an elevator rope obtained by: impregnating strands 6 with an impregnating solution which contains a hydroxy compound having two or more hydroxy groups per molecule and an isocyanate compound having two or more isocyanate groups per molecule and has a lower viscosity than the melt viscosity of a composition for forming a covering resin layer; heating the resultant product at 40° C. or more and 180° C. or less to mold the product into a impregnating solution-hardened product 9; and covering the periphery of the resultant strands 6 with a covering resin layer 7 including a molded product of the composition for forming a covering resin layer, which is produced by mixing a thermoplastic polyurethane elastomer, a thermoplastic resin other than the thermoplastic polyurethane elastomer and an isocyanate compound having two or more isocyanate groups per molecule.

As illustrated in FIG. 3, in this embodiment, the rope main body impregnated with the impregnating solution is heated at 40° C. or more and 180° C. or less to thermally expand the strands 6, and the impregnating solution penetrates gaps between wires in the strands 6, the gaps being generated by the thermal expansion. Further heating is carried out to react and harden the hydroxy compound having two or more hydroxy groups per molecule and the isocyanate compound having two or more isocyanate groups per molecule in the impregnating solution, to thereby fill the gaps in the strands 6 or the valley parts between wires in the strands 6 where the air layer 8 is liable to appear with the impregnating solution-hardened product 9. Subsequently, the rope main body is covered with the covering resin layer 7 including the molded product of the composition for forming a covering resin layer, which is produced by mixing the thermoplastic polyurethane elastomer, the thermoplastic resin other than the thermoplastic polyurethane elastomer and the isocyanate compound having two or more isocyanate groups per molecule, to thereby obtain an elevator rope without generating the air layer 8. In the thus-obtained elevator rope, even in the case where frictional heat is suddenly generated, such as at the time of an emergency stop of the elevator, heat is easily released, and temperature change on the friction interface becomes small, resulting in a small variation in the friction coefficient.

The viscosity of the impregnating solution before complete hardening is adjusted so as to be lower than the melt viscosity of the composition for forming a covering resin layer. In the case where the viscosity of the impregnating solution before complete hardening is higher than the melt viscosity of the composition for forming a covering resin layer, it is impossible to fill gaps in the strands 6 or valley parts between wires in the strands 6 where the air layer 8 is liable to appear. The viscosity of the impregnating solution is appropriately adjusted depending on the composition of the composition for forming a covering resin layer and the like, but is usually 500 mPa·s or more and 20,000 mPa·s or less, preferably 2,000 mPa·s or more and 5,000 mPa·s or less. The above-mentioned viscosity ranges are lower than the melt viscosity of a general thermoplastic polyurethane elastomer, and hence the impregnating solution can fill small gaps which are not filled by covering with the covering resin layer 7.

Meanwhile, in order to improve the thermal conductivity of the impregnating solution-hardened product 9, a thermally conductive inorganic filler may be added to the impregnating solution. The thermally conductive inorganic filler is not particularly limited, and examples thereof include boron nitride, aluminum nitride, silicon carbide, silicon nitride, alumina, and silica. Of those, boron nitride and aluminum nitride are more preferred because of high thermal conductivity. In addition, the blending amount of the thermally conductive inorganic filler is not particularly limited.

Figure 4:
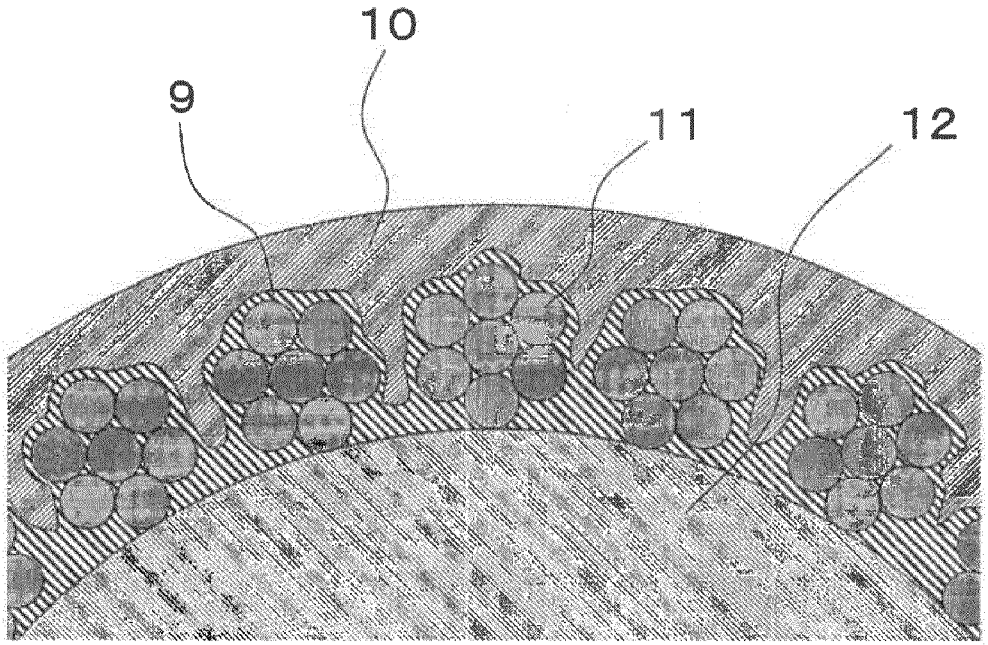
FIG. 4 is a schematic cross-sectional view of the vicinity of an outer layer of an elevator rope.

When a rope including steel wires having a multilayer structure, e.g., a rope having the structure shown in FIG. 1 of WO 2003/050348 A1, is impregnated with the impregnating solution before covering the outermost periphery with the covering resin layer and heated at from 40° C. or more to 180° C. or less, the impregnating solution-hardened product can be filled even if there are gaps between the steel wires in the rope outermost layer and the resin cladding where the steel wires in the outermost layer are twisted. FIG. 4 is a schematic cross-sectional view of the vicinity of an outer layer of an elevator rope having the structure shown in FIG. 1 of WO 2003/050348 A1, which is obtained by forming an impregnating solution-hardened product by the above-mentioned method before covering with an outer layer cladding. In FIG. 4, the numeral 9 denotes the impregnating solution-hardened product, the numeral 10 denotes the outer layer cladding, the numeral 11 denotes an outer layer strand, and the numeral 12 denotes an inner layer cladding. The outer layer strands 11 are each structured by a center wire disposed in the center and six peripheral wires disposed on the periphery of the center wire. In the elevator rope illustrated in FIG. 4, gaps between wires in the outer layer strands 11 and gaps between the outer layer strands 11 are filled with the impregnating solution-hardened product 9, and hence even in the case where frictional heat is suddenly generated, such as at the time of an emergency stop of the elevator, heat is easily released, and temperature change on the friction interface becomes small, resulting in a small variation in the friction coefficient. Further, even when the rope is bent and used, damage due to contact between wires can be reduced, and longer life of the elevator rope can be achieved.

According to Embodiment 3, it is possible to obtain an elevator rope having a small variation in the friction coefficient in a wide range of sliding velocities from a small sliding velocity range required for maintaining a static condition of an elevator car to a large sliding velocity range during emergency or sudden stops of an elevator in operation.

Embodiment 4

An elevator rope according to Embodiment 4 of the present invention is characterized in that the periphery of a rope main body impregnated with an impregnating solution which contains a hydroxy compound having two or more hydroxy groups per molecule and an isocyanate compound having two or more isocyanate groups per molecule is covered with a molded product of a composition for forming a covering resin layer, which is produced by mixing a thermoplastic polyurethane elastomer and inorganic fillers. It should be noted that the impregnating solution has a lower viscosity than the melt viscosity of the composition for forming a covering resin layer.

The elevator rope according to this embodiment is the same as that in Embodiment 2 except that the rope main body impregnated with the impregnating solution is used as the rope main body, and hence descriptions of the covering resin layer are omitted. As the rope main body before impregnation with the impregnating solution, the rope main body as exemplified in Embodiment 1 may be used. Meanwhile, as the impregnating solution, the same impregnating solution as exemplified in Embodiment 3 may be used, and a method of forming the impregnating solution-hardened product is the same as that in Embodiment 3. Therefore, descriptions of them are omitted. Further, in order to improve adhesion between the rope main body impregnated with the impregnating solution and the covering resin layer, an adhesive may be applied to the rope main body before covering with the covering resin layer. The type of the adhesive is not particularly limited, but epoxy-based, phenol-based, and urethane-based adhesives are preferred.

In this embodiment, the rope main body impregnated with the impregnating solution is heated at 40° C. or more and 180° C. or less to thermally expand the strand, and the impregnating solution penetrates gaps between wires in the strand, the gaps being generated by the thermal expansion. Further, heating is carried out to react and harden the hydroxy compound having two or more hydroxy groups per molecule and the isocyanate compound having two or more isocyanate groups per molecule in the impregnating solution, to thereby fill the gaps in the strand or the valley parts between wires in the strand where an air layer is liable to appear with the impregnating solution-hardened product. Subsequently, the rope main body is covered with the covering resin layer including the molded product of the composition for forming a covering resin layer, which is produced by mixing the thermoplastic polyurethane elastomer and the inorganic filler, to thereby obtain the elevator rope without generating the air layer. In the thus-obtained elevator rope, even in the case where frictional heat is suddenly generated, such as at the time of an emergency stop of the elevator, heat is easily released, and temperature change on the friction interface becomes small, resulting in a small variation in the friction coefficient.

According to Embodiment 4, it is possible to obtain an elevator rope having a small variation in the friction coefficient in a wide range of sliding velocities from a small sliding velocity range required for maintaining a static condition of an elevator car to a large sliding velocity range during emergency or sudden stops of an elevator in operation.

EXAMPLES

Hereinafter, the present invention is described in more detail by way of examples and comparative examples, but is not limited by the examples.

Example 1

5 parts by mass of an isocyanate batch obtained by kneading 1.85 parts by mass of a polystyrene resin, 1.3 parts by mass of an epoxy resin, and 1.85 parts by mass of 4,4'-diphenylmethane diisocyanate using a twin screw extruder were added to 100 parts by mass of an ether-based thermoplastic polyurethane elastomer having a JIS A hardness of 85, and the resultant was mixed well and supplied to an extrusion molding machine, to thereby mold the mixture as a covering resin layer for covering the periphery of a rope main body. The rope main body was covered with the covering resin layer and then heated at 100° C. for 2 hours to promote a reaction between the ether-based thermoplastic polyurethane elastomer and the isocyanate batch, to thereby obtain an elevator rope having a diameter of 12 mm. It should be noted that the resultant elevator rope had the cross-sectional structure described in FIG. 1 of WO 2003/050348 A1. Here, the rope main body corresponds to the elevator rope including: the inner layer rope having a plurality of core strands in each of which a plurality of steel wires are twisted together and a plurality of inner layer strands in each of which a plurality of steel wires are twisted together; the inner layer cladding made of a resin and covering the periphery of the inner layer rope; and the outer layer rope provided in a peripheral portion of the inner layer cladding and having a plurality of outer layer strands in each of which a plurality of steel wires are twisted together, and the covering resin layer corresponds to the outer layer cladding. Before covering the rope main body with the covering resin layer, Chemlok (registered trademark) 218 (manufactured by LORD Far East, Inc.) was applied to the peripheral strands of the rope main body and dried.

Example 2

The same procedure as in Example 1 was carried out except that the amount of the isocyanate batch added was changed to 20 parts by mass, to thereby obtain an elevator rope.

Example 3

The same procedure as in Example 1 was carried out except that an ether-based thermoplastic polyurethane elastomer having a JIS A hardness of 90 was used instead of the ether-based thermoplastic polyurethane elastomer having a JIS A hardness of 85, to thereby obtain an elevator rope.

Example 4

The same procedure as in Example 1 was carried out except that an ether-based thermoplastic polyurethane elastomer having a JIS A hardness of 90 was used instead of the ether-based thermoplastic polyurethane elastomer having a JIS A hardness of 85, and the amount of the isocyanate batch added was changed to 15 parts by mass, to thereby obtain an elevator rope.

Example 5

The same procedure as in Example 1 was carried out except that an ether-based thermoplastic polyurethane elastomer having a JIS A hardness of 95 was used instead of the ether-based thermoplastic polyurethane elastomer having a JIS A hardness of 85, to thereby obtain an elevator rope.

Example 6

The same procedure as in Example 1 was carried out except that an ether-based thermoplastic polyurethane elastomer having a JIS A hardness of 95 was used instead of the ether-based thermoplastic polyurethane elastomer having a JIS A hardness of 85, and the amount of the isocyanate batch added was changed to 10 parts by mass, to thereby obtain an elevator rope.

Example 7

The same procedure as in Example 1 was carried out except that an ether-based thermoplastic polyurethane elastomer having a JIS A hardness of 95 was used instead of the ether-based thermoplastic polyurethane elastomer having a JIS A hardness of 85, and 10 parts by mass of calcium carbonate were used instead of the isocyanate batch, to thereby obtain an elevator rope.

Example 8

The same procedure as in Example 7 was carried out except that 5 parts by mass of carbon black were used instead of 10 parts by mass of calcium carbonate, to thereby obtain an elevator rope.

Example 9

The same procedure as in Example 7 was carried out except that 10 parts by mass of talc were used instead of 10 parts by mass of calcium carbonate, to thereby obtain an elevator rope.

Example 10

The same procedure as in Example 7 was carried out except that 10 parts by mass of titanium oxide were used instead of 10 parts by mass of calcium carbonate, to thereby obtain an elevator rope.

Example 11

The same procedure as in Example 7 was carried out except that 10 parts by mass of silica were used instead of 10 parts by mass of calcium carbonate, to thereby obtain an elevator rope.

Example 12

The same procedure as in Example 1 was carried out except that an ether-based thermoplastic polyurethane elastomer having a JIS A hardness of 90 was used instead of the ether-based thermoplastic polyurethane elastomer having a JIS A hardness of 85, and 10 parts by mass of a glass fiber were used instead of the isocyanate batch, to thereby obtain an elevator rope.

Example 13

The same procedure as in Example 1 was carried out except that an ether-based thermoplastic polyurethane elastomer having a JIS A hardness of 95 was used instead of the ether-based thermoplastic polyurethane elastomer having a JIS A hardness of 85, and 10 parts by mass of calcium carbonate and 10 parts by mass of the isocyanate batch were used instead of 5 parts by mass of the isocyanate batch, to thereby obtain an elevator rope.

Example 14

The same procedure as in Example 13 was carried out except that 5 parts by mass of carbon black were used instead of 10 parts by mass of calcium carbonate, to thereby obtain an elevator rope.

Example 15

The same procedure as in Example 13 was carried out except that 10 parts by mass of talc were used instead of 10 parts by mass of calcium carbonate, to thereby obtain an elevator rope.

Example 16

The same procedure as in Example 13 was carried out except that 10 parts by mass of titanium oxide were used instead of 10 parts by mass of calcium carbonate, to thereby obtain an elevator rope.

Example 17

The same procedure as in Example 13 was carried out except that 10 parts by mass of silica were used instead of 10 parts by mass of calcium carbonate, to thereby obtain an elevator rope.

Example 18

The same procedure as in Example 13 was carried out except that 10 parts by mass of mica were used instead of 10 parts by mass of calcium carbonate, to thereby obtain an elevator rope.

Example 19

The same procedure as in Example 1 was carried out except that an ether-based thermoplastic polyurethane elastomer having a JIS A hardness of 90 was used instead of the ether-based thermoplastic polyurethane elastomer having a JIS A hardness of 85, and 10 parts by mass of a glass fiber and 10 parts by mass of the isocyanate batch were used instead of 5 parts by mass of the isocyanate batch, to thereby obtain an elevator rope.

Example 20

The same procedure as in Example 19 was carried out except that 10 parts by mass of a carbon fiber were used instead of 10 parts by mass of the glass fiber, to thereby obtain an elevator rope.

Example 21

The same rope main body as in Example 1 was impregnated with an impregnating solution (viscosity 2,500 mPa·s) obtained by mixing a solution prepared by dissolving ethylene glycol in methyl ethyl ketone and a solution prepared by dissolving 4,4'-diphenylmethane diisocyanate in butyl acetate, and heated at 120° C., to thereby obtain a rope main body subjected to the impregnating treatment. Subsequently, 5 parts by mass of an isocyanate batch obtained by kneading 1.85 parts by mass of a polystyrene resin, 1.3 parts by mass of an epoxy resin, and 1.85 parts by mass of 4,4'-diphenylmethane diisocyanate using a twin screw extruder were added to 100 parts by mass of an ether-based thermoplastic polyurethane elastomer having a JIS A hardness of 95, and the resultant was mixed well and supplied to an extrusion molding machine, to thereby mold the mixture as a covering resin layer for covering the periphery of the rope main body obtained above. It should be noted that the melt viscosity of the composition for forming a covering resin layer was $1.0\times10^7$ mPa·s. The rope main body was covered with the covering resin layer and then heated at 100° C. for 2 hours to promote a reaction between the ether-based thermoplastic polyurethane elastomer and the isocyanate batch, to thereby obtain an elevator rope having a diameter of 12 mm. It should be noted that before covering the rope main body with the covering resin layer, Chemlok (registered trademark) 218 (manufactured by LORD Far East, Inc.) was applied to the peripheral strands of the rope main body and dried.

Example 22

The same procedure as in Example 21 was carried out except that 10 parts by mass of the isocyanate batch and 10 parts by mass of talc were used instead of 5 parts by mass of the isocyanate batch, to thereby obtain an elevator rope. It should be noted that the melt viscosity of the composition for forming a covering resin layer was $1.0\times10^7$ mPa·s.

Example 23

The same procedure as in Example 21 was carried out except that 10 parts by mass of talc were used instead of 5 parts by mass of the isocyanate batch, to thereby obtain an elevator rope. It should be noted that the melt viscosity of the composition for forming a covering resin layer was $1.0\times10^7$ mPa·s.

Comparative Example 1

The same procedure as in Example 1 was carried out except that only the ether-based thermoplastic polyurethane elastomer having a JIS A hardness of 85 was used without using the isocyanate batch, to thereby obtain an elevator rope.

Comparative Example 2

The same procedure as in Comparative Example 1 was carried out except that an ether-based thermoplastic polyurethane elastomer having a JIS A hardness of 90 was used instead of the ether-based thermoplastic polyurethane elastomer having a JIS A hardness of 85, to thereby obtain an elevator rope.

Comparative Example 3

The same procedure as in Comparative Example 1 was carried out except that an ether-based thermoplastic polyurethane elastomer having a JIS A hardness of 95 was used instead of the ether-based thermoplastic polyurethane elastomer having a JIS A hardness of 85, to thereby obtain an elevator rope.

Comparative Example 4

The same procedure as in Comparative Example 1 was carried out except that an ether-based thermoplastic polyurethane elastomer having a JIS A hardness of 98 was used instead of the ether-based thermoplastic polyurethane elastomer having a JIS A hardness of 85, to thereby obtain an elevator rope.

[Measurement of Glass Transition Temperature (Tg) of Covering Resin Layer]

The glass transition temperature (Tg) of the covering resin layer was measured as follows. A composition for molding having the same composition as that of the covering resin layer used in each of the Examples and Comparative Examples was supplied to an extrusion molding machine and molded into a plate having a size of 100 mm×100 mm×thickness 2 mm, followed by heating at 100° C. for 2 hours, and then a test piece having a size of 50 mm×10 mm×thickness 2 mm was cut off from the center portion of the plate. The loss modulus of the test piece was measured using a viscoelastic spectrometer DMS120 manufactured by Seiko Instruments Inc. under conditions of deformation mode: bending mode, measurement frequency: 10 Hz, temperature increase rate: 2° C./min, and vibration amplitude: 10 μm, and the peak temperature of the loss modulus was adopted as Tg. Table 1 shows the results.

[JIS A Hardness of Covering Resin Layer]

According to JIS K7215, a type A durometer was used to measure durometer A hardness. Table 1 shows the results.

[Measurement of Friction Coefficient of Rope]

(1) Measurement Method in Small Sliding Velocity Range

Figure 5:
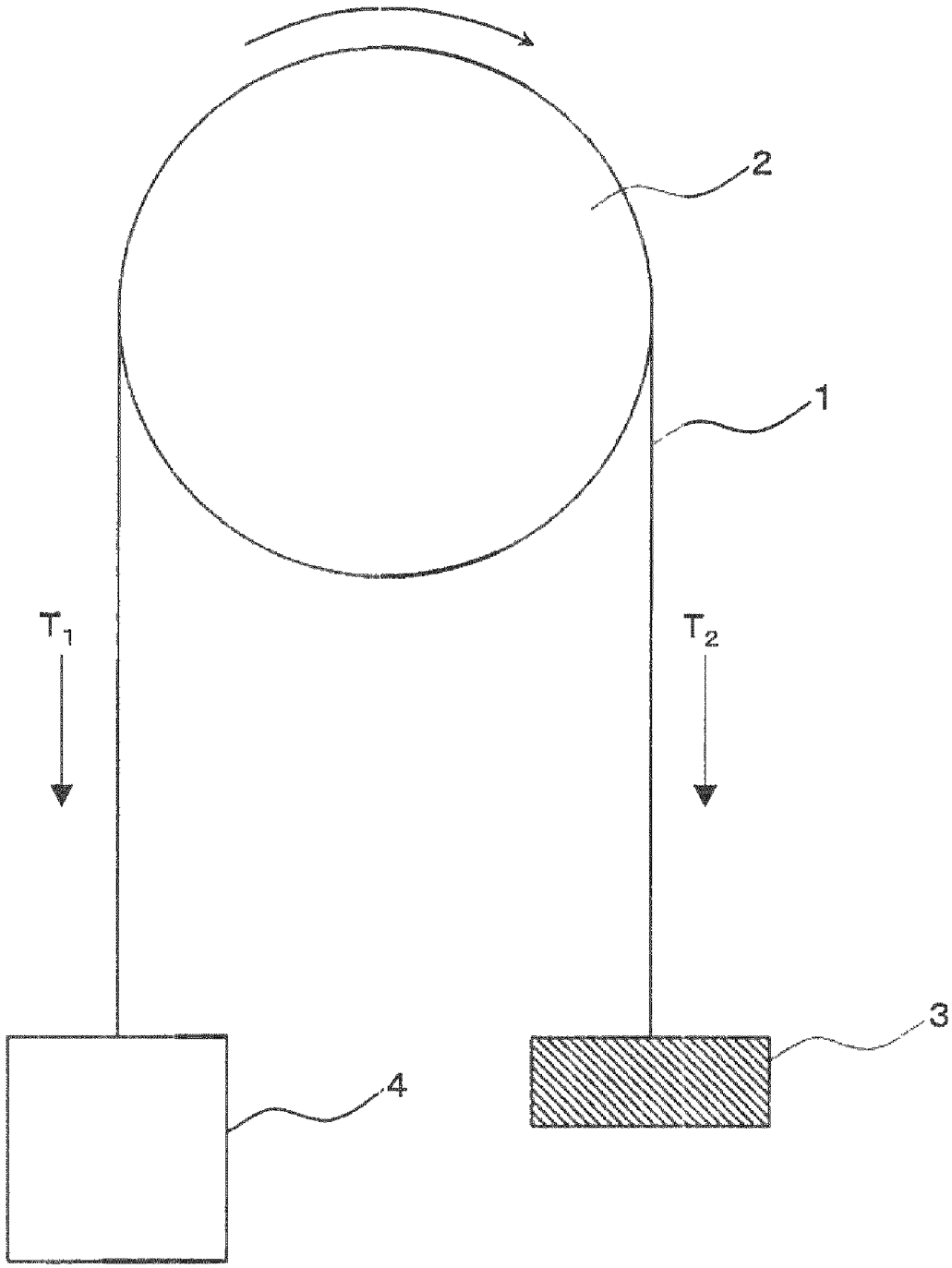
FIG. 5 is a conceptual diagram of an apparatus for measuring the friction coefficient in a small sliding velocity range used in the Examples.

FIG. 5 is a conceptual diagram of an apparatus for measuring the friction coefficient in a small sliding velocity range. As illustrated in FIG. 5, an elevator rope 1 obtained in each of the Examples and Comparative Examples was twisted 180 degrees around a sheave 2, and one end thereof was fixed on a measurement apparatus 3. The other end was connected to a weight 4, and a tension was applied to the elevator rope 1. Here, when the sheave 2 was rotated in a clockwise direction at a predetermined rate, rope tension on the fixed side ($T_2$) loosens just for the friction force between the elevator rope 1 and the sheave 2, resulting in a tension difference from rope tension on the weight side ($T_2$). The rope tension on the weight side ($T_1$) and rope tension on the fixed side ($T_2$) were measured using a load cell provided on the connection part between the rope and the weight. The small sliding velocity range was defined as $1\times10^{-5}$ mm/s or less, and $T_1$ and $T_2$ (provided that $T_1>T_2$), a contact angle of the rope on the sheave θ (=180 degrees), and a coefficient $K_2$ (=1.19) determined by the shape of the groove of the sheave were substituted into the following equation 1, to thereby determine a friction coefficient $\mu_1$ between the elevator rope 1 and the sheave 2. Table 1 shows the results.

$$\mu_1 = \frac{\ln(T_1/T_2)}{K_2\theta} \quad \text{(Equation 1)}$$

Figure 6:
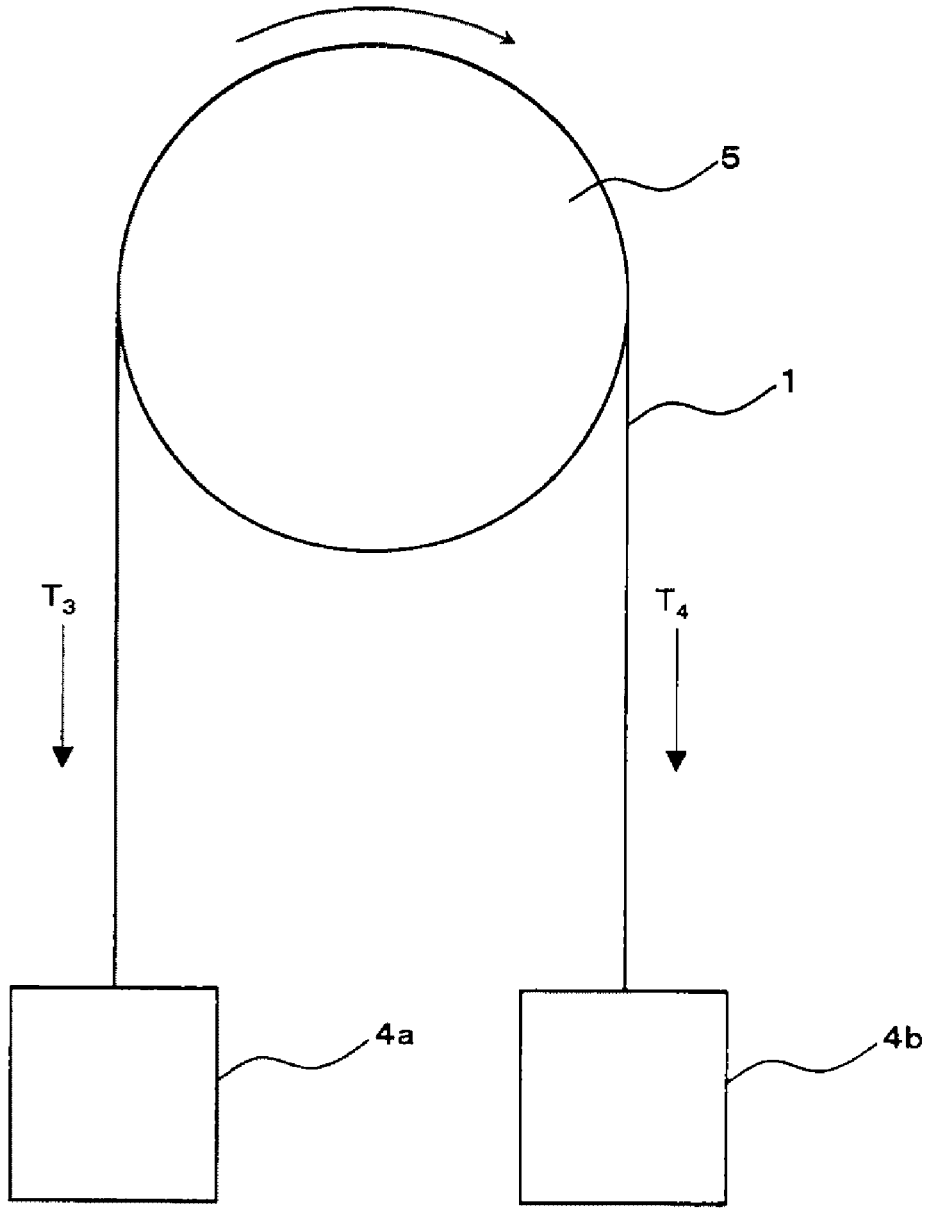
FIG. 6 is a conceptual diagram of an apparatus for measuring the friction coefficient at the time of an emergency stop used in the Examples.

(2) Measurement Method in Large Sliding Velocity Range at the Time of an Emergency Stop FIG. 6 is a conceptual diagram of an apparatus for measuring a friction coefficient in a large sliding velocity range at the time of an emergency stop. The elevator rope 1 obtained in each of the Examples and Comparative Examples was twisted 180 degrees around a driving sheave 5. One end thereof was connected to a weight 4*a*, and the other end was connected to a weight 4*b* having a larger mass than the weight 4*a*. The rope groove of the driving sheave 5 used here was a U-shaped groove having a size of Φ15 mm and depth 20 mm, and no further special processing was performed on the sheave. The driving sheave 5 was rotated in a clockwise direction to raise the weight 4*a*, and the driving sheave 5 was suddenly stopped when the rope speed reached 4 m/s, to thereby have the elevator rope 1 slip against the driving sheave 5. In this case, the minimum deceleration α of the weight 4*a*, the tension on the weight 4*a* side ($T_3$), and the tension on the weight 4*b* side ($T_4$) were measured using a load cell provided on the connection part between the rope and the weight, and the resultant values were substituted into the following equation 2, to thereby determine a minimum friction coefficient $\mu_2$ during slipping. Table 1 shows the results.

$$\mu_2 = \frac{\ln(T_4(1+\alpha/g)/T_3(1+\alpha/g))}{K_2\theta} \quad \text{(Equation 2)}$$

Here, $K_2$ represents the same value as that used in the measurement method in the small sliding velocity range, g represents a gravity constant (=9.80665 m/s$^2$), and θ represents a contact angle of the rope on the sheave (=180 degrees).

It should be noted that a rope having a rope friction coefficient of less than 0.15 was estimated as x, a rope having a rope friction coefficient of 0.15 or more and less than 0.2 was estimated as Δ, a rope having a rope friction coefficient of 0.2 or more and less than 0.25 was estimated as ○, and a rope having a rope friction coefficient of 0.25 or more was estimated as ◎.

TABLE 1

| | Glass transition temperature (° C.) | JIS A hardness | Friction coefficient Small sliding | Friction coefficient Emergency stop |
|---|---|---|---|---|
| Example 1 | −42 | 86 | Δ | Δ |
| Example 2 | −38 | 88 | Δ | Δ |
| Example 3 | −39 | 91 | Δ | Δ |
| Example 4 | −36 | 94 | Δ | Δ |
| Example 5 | −29 | 96 | ○ | Δ |
| Example 6 | −28 | 97 | ○ | Δ |
| Example 7 | −27 | 95 | ○ | Δ |
| Example 8 | −26 | 95 | ○ | Δ |
| Example 9 | −25 | 96 | ○ | Δ |
| Example 10 | −25 | 95 | ○ | Δ |
| Example 11 | −22 | 95 | ○ | Δ |
| Example 12 | −24 | 94 | ○ | Δ |
| Example 13 | −25 | 97 | ○ | ○ |
| Example 14 | −25 | 96 | ○ | ○ |
| Example 15 | −25 | 97 | ○ | ◎ |
| Example 16 | −24 | 97 | ○ | ○ |
| Example 17 | −21 | 98 | ○ | ◎ |
| Example 18 | −23 | 98 | ○ | ○ |
| Example 19 | −25 | 97 | ○ | ◎ |
| Example 20 | −22 | 97 | ○ | ◎ |
| Example 21 | −43 | 88 | ○ | ○ |
| Example 22 | −25 | 93 | ○ | ◎ |
| Example 23 | −26 | 95 | ○ | ◎ |
| Comparative Example 1 | −43 | 85 | X | X |
| Comparative Example 2 | −40 | 90 | X | X |
| Comparative Example 3 | −30 | 95 | X | X |
| Comparative Example 4 | −10 | 98 | Δ | X |

As is clear from the results shown in Table 1, the friction coefficients in the small sliding velocity range ($1\times10^{-5}$ mm/s) and at the time of an emergency stop, determined using the elevator ropes obtained in the Examples and Comparative Examples, were found to have a tendency of being lower than the friction coefficients during normal operation (0.3 to 0.4). All the elevator ropes obtained in the Examples were found to have friction coefficients of 0.15 or more in the small sliding velocity range and at the time of an emergency stop, and about 40% of the friction coefficient was able to be maintained compared with the friction coefficient during normal operation. In particular, in Examples 13 to 20 where the isocyanate compound serving as a cross-linking agent and the inorganic filler were used in combination, variations in the friction coefficients were found to be small. Specifically, in the cases of the ropes having added thereto the plate-like inorganic filler such as talc or mica and the ropes having added thereto the fibrous inorganic filler such as the glass fiber or the carbon fiber, variations in the friction coefficients were found to be small. Meanwhile, in the cases of the elevator ropes of Examples 21 to 23, variations in the friction coefficients at the time of an emergency stop were found to be smaller than those of the ropes impregnated with no impregnating solution (Examples 5, 9, and 15).

On the other hand, in the cases of all the elevator ropes obtained in the Comparative Examples, variations in the friction coefficients were large, and the friction coefficients were less than 0.15.

REFERENCE SIGNS LIST

1 elevator rope, 2 sheave, 3 measurement apparatus, 4, 4*a*, 4*b* weight, 5 driving sheave, 6 strand, 7 covering resin layer, 8 air layer, 9 impregnating solution-hardened product, 10 outer layer cladding, 11 outer layer strand, 12 inner layer cladding.

The invention claimed is:

1. An elevator rope, comprising:

a rope main body; and a covering resin layer that covers the periphery of the rope main body and comprises a molded product of a composition for forming a covering resin layer, wherein the composition is produced by mixing a thermoplastic polyurethane elastomer and an isocyanate compound having two or more isocyanate groups per molecule.

2. An elevator rope, comprising:

a rope main body; and a covering resin layer that covers the periphery of the rope main body and comprises a molded product of a composition for forming a covering resin layer, wherein the composition is produced by mixing a thermoplastic polyurethane elastomer, a thermoplastic resin other than the thermoplastic polyurethane elastomer and an isocyanate compound having two or more isocyanate groups per molecule.

3. An elevator rope according to claim 2, wherein the rope main body is impregnated with an impregnating solution comprising a hydroxyl compound having two or more hydroxyl groups per molecule and an isocyanate compound having two or more isocyanate groups per molecule and having a lower viscosity than a melt viscosity of the composition for forming the covering resin layer.

4. An elevator rope according to claim 2, wherein inorganic fillers are further mixed in the composition for forming the covering resin layer.

5. An elevator rope according to claim 4, wherein the inorganic fillers are in either fibrous or plate-like form.

6. An elevator rope according to claim 2, wherein the composition for forming the covering resin layer is produced by mixing the thermoplastic resin and the isocyanate compound in an amount within the range of 5 to 20 parts by mass in total with respect to 100 parts by mass of the thermoplastic polyurethane elastomer so that the molded product has a JIS A hardness of 98 or less and a glass transition temperature of −20° C. or less.

7. An elevator rope, comprising:

a rope main body; and a covering resin layer that covers the periphery of the rope main body and comprises a molded product of a composition for forming the covering resin layer, wherein the composition is produced by mixing a thermoplastic polyurethane elastomer and inorganic fillers.

8. An elevator rope according to claim 7, wherein the rope main body is impregnated with an impregnating solution comprising a hydroxyl compound having two or more hydroxyl groups per molecule and an isocyanate compound having two or more isocyanate groups per molecule and having a lower viscosity than a melt viscosity of the composition for forming the covering resin layer.

9. An elevator rope according to claim 7, wherein the composition for forming the covering resin layer is produced by mixing the inorganic filler in an amount within the range of 3 to 20 parts by mass with respect to 100 parts by mass of the thermoplastic polyurethane elastomer so that the molded product has a JIS A hardness of 98 or less and a glass transition temperature of −20° C. or less.

10. An elevator rope according to claim 2, wherein the thermoplastic polyurethane elastomer is selected from the group consisting an ester-based thermoplastic polyurethane elastomer, an ether-based thermoplastic polyurethane elastomer, an ester-ether-based thermoplastic polyurethane elastomer, a carbonate-based thermoplastic polyurethane elastomer and a mixture thereof.

11. An elevator rope according to claim 2, wherein the thermoplastic polyurethane elastomer is an ether-based thermoplastic polyurethane elastomer.

12. An elevator rope according to claim 2, wherein the thermoplastic polyurethane elastomer has a JIS A hardness according to JIS K7215 of from 85 to 95.

13. An elevator rope according to claim 2, wherein the thermoplastic resin other than the thermoplastic polyurethane elastomer is selected from the group consisting of an epoxy resin, a polystyrene resin, a polyvinyl chloride resin, a polyvinyl acetate resin, an ethylene-vinyl acetate copolymer resin, a polyethylene resin, a polypropylene resin, and a polyester resin.

14. An elevator rope according to claim 6, wherein the JIS A hardness is 85 or more.

15. An elevator rope according to claim 14, wherein the glass transition temperature is −25° C. or less.

* * * * *